US010502011B2

(12) United States Patent
Peveri

(10) Patent No.: US 10,502,011 B2
(45) Date of Patent: Dec. 10, 2019

(54) METHOD AND APPARATUS FOR CONTINUOUSLY CONTROLLING A WELL FLOW RATE

(71) Applicant: Schlumberger Technology Corporation, Sugar Land, TX (US)

(72) Inventor: Luigi Peveri, Piacenza (IT)

(73) Assignee: Schlumberger Technology Corporation, Sugar Land, TX (US)

( * ) Notice: Subject to any disclaimer, the term of this patent is extended or adjusted under 35 U.S.C. 154(b) by 454 days.

(21) Appl. No.: 15/520,396

(22) PCT Filed: Oct. 7, 2014

(86) PCT No.: PCT/IB2014/065104
§ 371 (c)(1),
(2) Date: Apr. 19, 2017

(87) PCT Pub. No.: WO2015/177607
PCT Pub. Date: Nov. 26, 2015

(65) Prior Publication Data

US 2017/0260821 A1 Sep. 14, 2017

(30) Foreign Application Priority Data

May 19, 2014 (IT) ..... MI2014A000904

(51) Int. Cl.

| | |
|---|---|
| ***E21B 21/08*** | (2006.01) |
| ***E21B 47/06*** | (2012.01) |
| ***E21B 21/10*** | (2006.01) |
| ***G01F 1/44*** | (2006.01) |
| ***E21B 47/10*** | (2012.01) |
| ***E21B 34/02*** | (2006.01) |

(52) U.S. Cl.
CPC ..... *E21B 21/08* (2013.01); *E21B 21/106* (2013.01); *E21B 34/02* (2013.01); *E21B 47/10* (2013.01); *E21B 47/06* (2013.01); *E21B 47/065* (2013.01)

(58) Field of Classification Search
CPC ..... E21B 21/08; E21B 47/06; E21B 34/02; E21B 21/10; E21B 21/106; G01F 1/44
See application file for complete search history.

(56) References Cited

U.S. PATENT DOCUMENTS

| | | | | |
|---|---|---|---|---|
| 6,910,388 | B2 * | 6/2005 | Jones | G01F 1/44 73/861.63 |
| 7,836,973 | B2 * | 11/2010 | Belcher | E21B 17/042 175/25 |
| 9,062,538 | B2 * | 6/2015 | Arellano | E21B 43/121 |
| 2010/0084142 | A1 | 4/2010 | Calderoni et al. | |
| 2013/0068532 | A1 | 3/2013 | Bansal et al. | |

FOREIGN PATENT DOCUMENTS

| | | | |
|---|---|---|---|
| CN | 102400653 | A | 4/2012 |
| EP | 1898044 | A2 | 3/2008 |
| GB | 2230312 | A | 10/1990 |

OTHER PUBLICATIONS

International Search Report and Written Opinion for the equivalent International patent application PCT/IB2014/065104 dated Aug. 4, 2015.

* cited by examiner

*Primary Examiner* — Catherine Loikith
(74) *Attorney, Agent, or Firm* — Jeffrey D. Frantz

(57) ABSTRACT

A method for continuously controlling fluid flow rates through a well (4) provides to shut off the drilling mud at the well inlet and outlet and detect measurements of flow rate and density of said drilling mud by a Venturi measuring device (10,2).

19 Claims, 10 Drawing Sheets

1- FEEDING MUD MATERIAL

2- FILLING ANNULUS

METHOD AND APPARATUS FOR CONTINUOUSLY CONTROLLING A WELL FLOW RATE

CROSS REFERENCE TO RELATED APPLICATIONS

This application is a National Stage application of International Application No. PCT/IB2014/065104 filed Oct. 7, 2014, which claims priority to and the benefit of an Italian Application having Serial No. MI2014A000904, filed May 19, 2014, which is incorporated by reference herein.

BACKGROUND OF THE INVENTION

The present invention relates to a method and apparatus for continuously controlling the flow-rate through a well.

More particularly, the present invention relates to a continuously circulation drilling method, which may be also carried out as the drilling rods are replaced or exchanged, by means of a special valve battery and an additional mud switching circuit for switching muds, while preventing any water hammering events.

As is known, a drilling operation is affected by the following main operating problems:

reservoir kick phenomena conveying to a ground surface highly pressurized reservoir gases or fluids;

well absorption phenomena during the drilling operations, causing a reservoir perforating mud dispersion and related economic/environmental problems;

a complex control of the mud material introduced into the well;

a complex control of the outlet mud characteristics;

a very dangerous re-rising of gases;

the requirement of performing in a safe condition the rod exchanging operations; and a complex control of all physical and fluidynamic parameters of the well.

In prior mud-circulating and drilling methods, have already been used different control systems for controlling the well inlet and outlet flow rates, to detect the well kick or absorbing phenomena. The well inlet drilling mud flow rate Is set by a system pump to be a constant one, whereas the standard well outlet flow rate, in the absence of well failures, should be equal to the inlet flow rate (with a set measurement error tolerance).

Prior studies on the well reservoir drilling performance have shown that, in many cases, the well outlet flow rate was not constant and, moreover, not comparable with the well inlet flow rate.

Such a variation is due to phenomena occurring in the well and which in some cases can negatively affect the drilling result.

Moreover, prior well control systems for controlling mud circulating drilling methods monitor the well inlet and outlet flow-rates and operating pressures, by means of the choke valves, properly monitoring the well backpressure and dangerous related events.

However, said prior systems do not comprise fluid control means for controlling the switching off of the system pumps for exchanging the drilling string rods.

Since the above mentioned "kick" phenomenon derives from the fact that it is not possible to hold in the well bore a constant pressure, any increase and decrease of the pressure on the bore walls causes a hydraulic fracturing, even at undesired positions.

Moreover, a continuous circulation prevents debris or waste material from falling down bore, thereby the waste materials continuously moves upward the well, in turn preventing any well battery engaging, with consequent time equipment or well losses.

Prior measurement systems for carrying out mud flow rate measurements, just limited by the mud characteristics, comprise mass measuring Coriolis devices, (designed for measuring the mud flow rate and density), or Venturi measuring devices, operating based on a Venturi momentum variation.

To the above it should be also added that some oil Companies commercially use a flow rate and density measuring control system based on a Coriolis' Meter, the drilling system being a software so controlled as to prevent kick phenomena.

Said prior systems are affected by great limitations since a Coriolis' measuring device, in presence of gas, is not able of measuring and detecting the gas presence and, accordingly, it is necessary to manually drive the systems, thereby the measured data must be further evaluated by an operator (for detecting if a well kick or absorbing phenomenon is being occurring).

Moreover, said prior systems do not detect the well inlet flow rate, which is instead calculated by using the pump operating strokes which calculation, on the other hand, (even if from an operator standpoint could constitute a set point of reference) could be dangerous and misleading.

In fact, for properly measuring well flow rates by pump strokes, it is necessary to know the pump efficiency, as well as to predict possible pump failures.

Thus, a pump stroke method is considered a redundant measurement method for detecting the pump efficiency and operation capability, but it cannot be used as a reference measuring method.

Moreover, prior measurement Coriolis systems are very expensive and must be subjected to periodic servicing operations to prevent measurement vibrating pipes from being clogged.

SUMMARY OF THE INVENTION

Accordingly, the aim of the present invention is to provide a method for continuously controlling a well fluid flow rate at an inlet and outlet of a well, adapted to overcome the above mentioned prior art drawbacks.

According to one aspect of the present invention, the above aim, as well as yet other objects, which will become more apparent hereinafter, are achieved by a method for continuously controlling a well fluid flow rate, characterized in that said method provides a step of shutting of a well inlet and outlet drilling mud and performing thereon flow rate and density measurements by a Venturi measuring device.

BRIEF DESCRIPTION OF THE DRAWINGS

Further characteristics and advantages of the present invention will become more apparent hereinafter from the following disclosure of a preferred, though not exclusive, embodiment of the invention, which is illustrated, by way of an indicative, but not limitative example, in the accompanying drawings, where.

DESCRIPTION OF THE PREFERRED EMBODIMENTS

Figure 1:
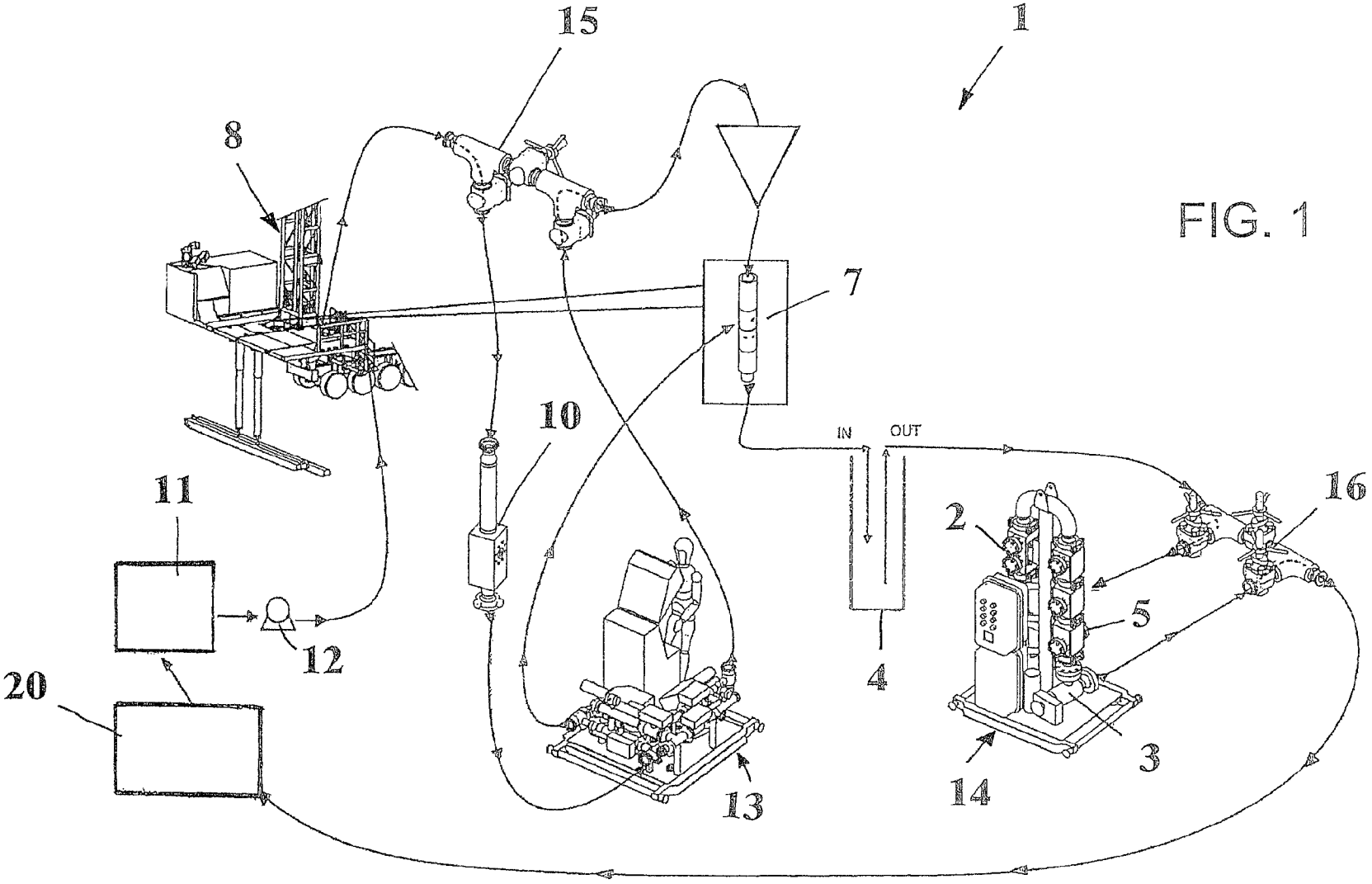
FIG. 1 is a perspective view of an oil well drilling system, according to the present invention.
Figure 2:
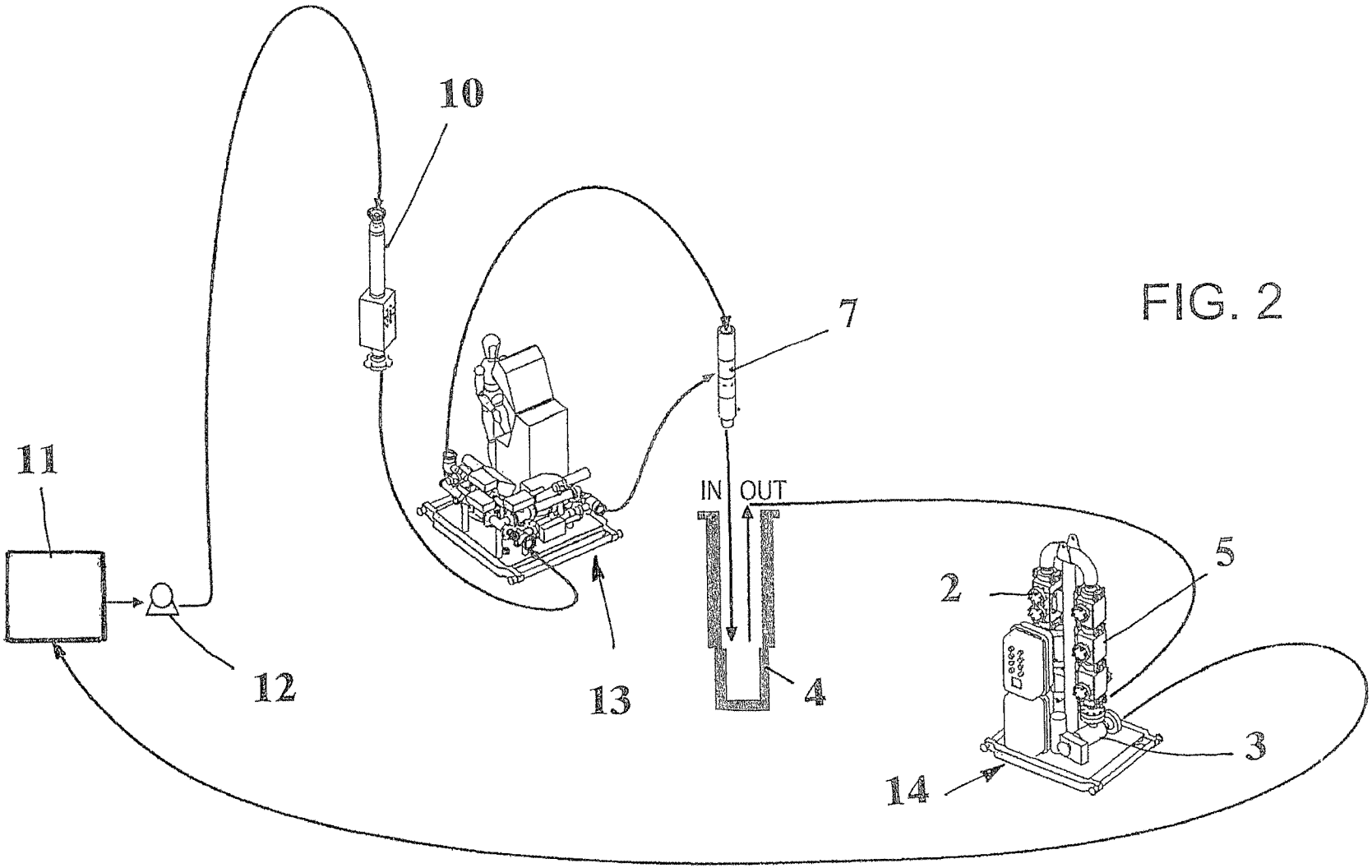
FIG. 2 is a further perspective view showing the main components of the oil well drilling system according to the present invention.

With reference to the number references of the above mentioned figures, a standard well drilling system, generally indicated by the reference number 1, comprises a drilling rig 8, arranged at a well 4, and a drilling mud circulating system comprising a drilling mud tank 11 and pump 12.

The inventive system for continuously controlling fluid flow-rates comprises two flow-rate measuring devices, that is a first measuring device 10 at the well inlet, and a second Venturi measuring device 2 at the well outlet, the latter detecting any flow-rate differences and, by a dedicated software program, adjusting the related flows by a choke valve 3, arranged downstream the well 4.

Said controlling system precisely detects the fluid, (either liquid or gas), stated by two Venturi measuring devices 10 and 2 and a density measuring device 5 series arranged through an operating circuit, so as to properly evaluate or detect the fluid pressure and temperature conditions.

A dedicated data processing system records the detected values and so adjust the choke valve 3 inlet port to prevent any materials from entering the well 4 or being ejected therefrom.

Said controlling system continuously operates even during a drilling rod replacing step, in which, in a conventional type of method, the fluid flow is stopped, by a mud circulating system, without hammering phenomena, and a switching device 7, allowing a continuous circulation even in said rod exchanging step.

More specifically, the apparatus according to the present invention comprises a first operating assembly, the so-called "skid", indicated by the reference number 13, including a first Venturi measuring device 10 and a hydraulic circuit for deviating or switching the mud flow into two directions, i.e. a radial and an axial direction, of said switching device 7 as it will be disclosed in a more detailed manner hereinafter.

The apparatus further comprises a hydraulic circuit including a male valve commanded by an oleodynamic control central unit, which motor is air supplied and electrically servo-controlled either in situ and/or from a remote location, through a radio controlled (wi-fi) control system.

The apparatus further comprises a plurality of said switching devices 7 designed to be engaged in a drilling battery and having an outside dimension similar to that of the drilling rods, and also designed for allowing special equipments to easily pass therethrough.

As shown, said switching device 7 comprises an axial valve 71 and a radial valve 72, both of a withdrawable type, allowing fluid to be conveyed in two directions for exchanging or replacing the drilling rods without stopping the drilling mud flow.

A second operating assembly, also called "skid", indicated by the reference number 14, comprises the second Venturi measuring device 2, the density measuring device 5, the choke valve 3 and an electronic central processing unit.

The second Venturi measuring device 2 and the density measuring device 5 provide measurements of the fluid characteristics without the need of using movable components, thereby they do not introduce system errors and are subjected to a small wearing out.

Said electronic central processing unit processes data through reference parameters and adjusts the choke valve 3 inlet port.

The system information may be sent to a remote PC, to safely control any drilling operations during the overall drilling period.

The apparatus according to the present invention also comprises a first switching manifold 15, associated with the first skid 13, and a second switching manifold 16, associated with the second skid 14, said manifolds being arranged both upstream and downstream of the respective skids.

Said switching manifolds 15 and 16, each of which comprises three valves, allow to reset the original hydraulic circuit, thereby insulating the additional operating circuits according to the present invention, in a case of failure or servicing operations.

The full operating cycle of the apparatus, through each component thereof will be thereinafter disclosed starting from any desired point of the closed loop or circuit system, for example from the system pump 12 pumping "make-up" drilling mud from the mud tank 11.

More specifically, said drilling mud is pumped into a standard standpipe manifold of the drilling system 8, where it is conveyed in a set direction and being controlled by conventional drilling controlling methods.

In particular, the drilling mud at the well inlet is conveyed through the first manifold 15 and directed to the first skid 13, or directly to a top drive, if the control system must be by-passed.

Upon entering the first skid 13, the drilling mud passes through the first Venturi measuring device 10, thereby well inlet fluid information will be achieved.

The first skid 13 switches the flow to the "top drive" while passing through the first switching manifold 15, during the drilling operation, or through the switching device 7, during the rod replacement operating step.

Figure 3:
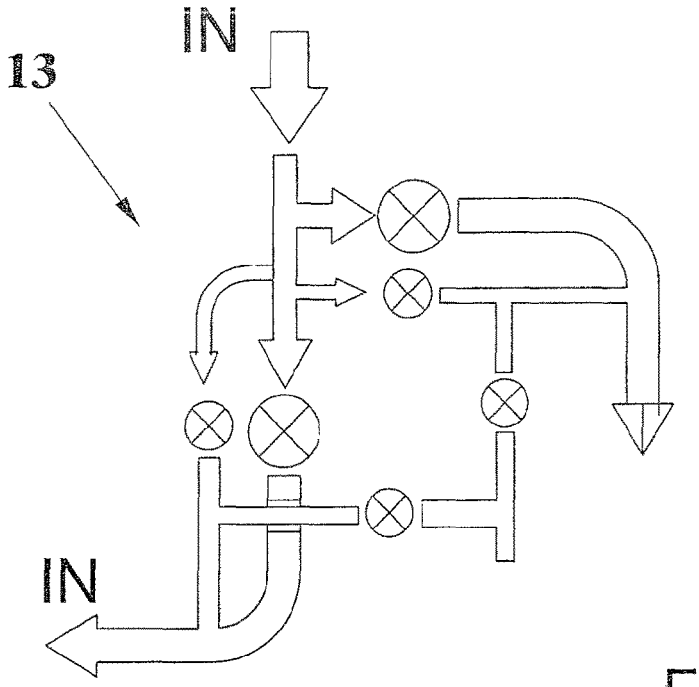
FIG. 3 is a schematic view showing a hydraulic circuit of a first skid.
Figure 4:
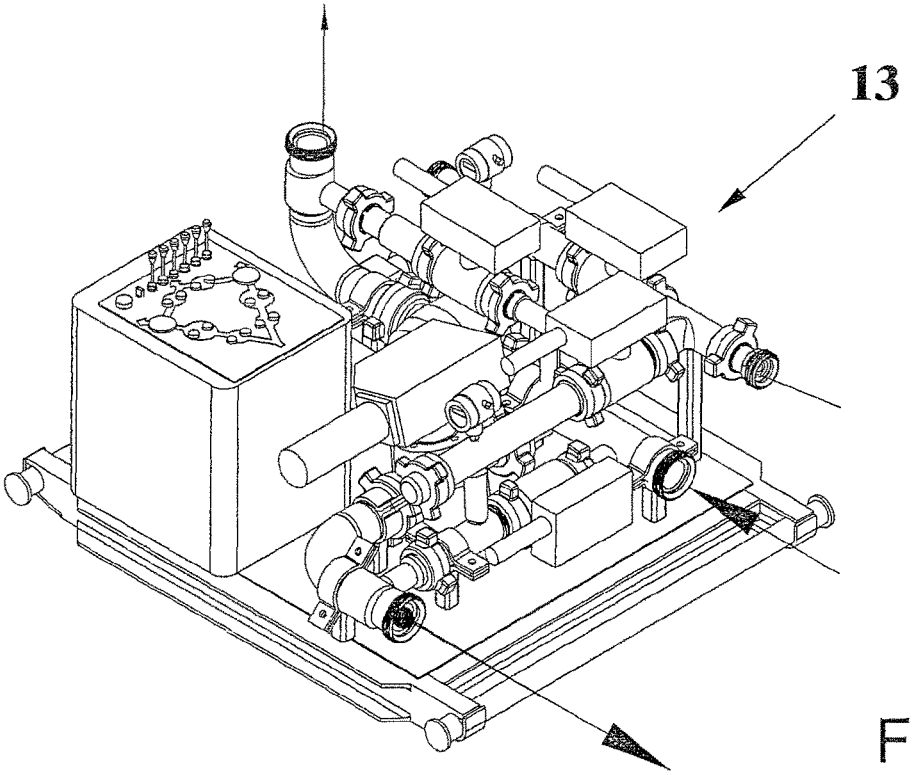
FIG. 4 is a perspective view of the first skid.

The first skid 13, shown in FIG. 4, comprises a schematically shown hydraulic circuit shown in FIG. 3 for conveying the flow without hammering phenomena.

Since the hydraulic circuit is specifically designed to that end, it allows to preliminarily fill-in empty tubes through a small valve having a narrowed valve portion.

After having filled-in the chamber, a larger flow valve may be opened.

Since this operation is performed in a balanced pressure condition, the male valve does not require a large driving torque for opening/closing, thereby the reduced effort and friction will provide a greatly efficient operation.

Figure 5:
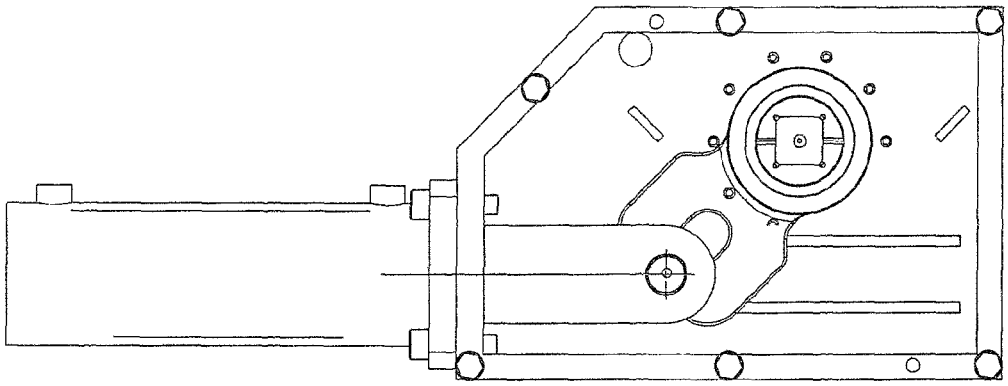
FIGS. 5 and 6 are yet other perspective views of a hydraulic actuator operating on male valves of the first skid.
Figure 6:
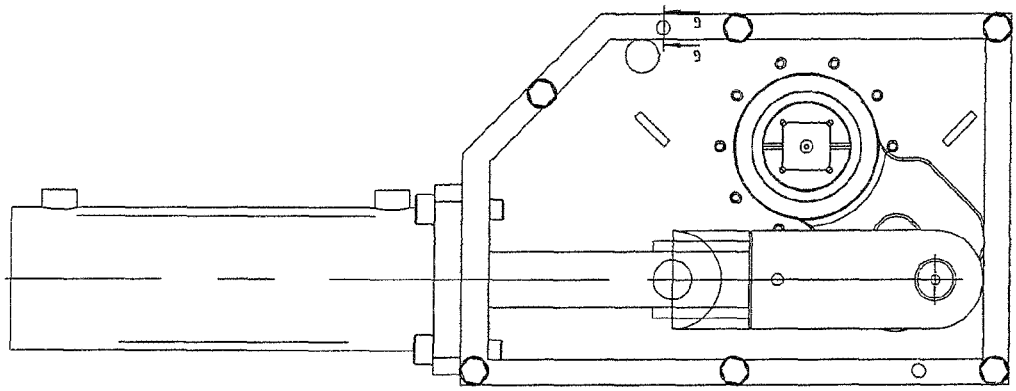
Figure 8:
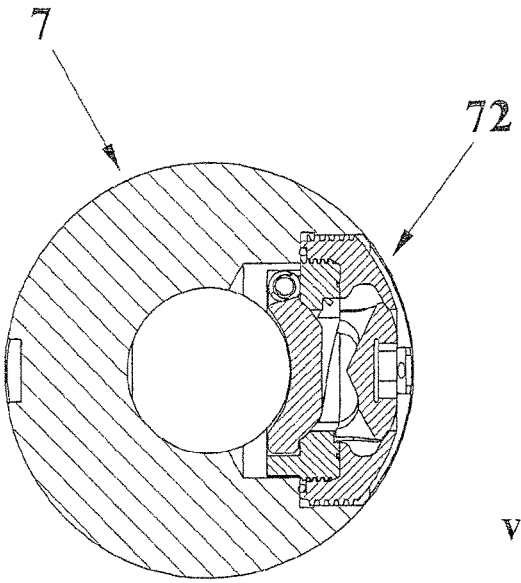
FIG. 8 is a cross-sectioned view, taken through the plane VIII-VIII of FIG. 7, of the above switching or deviating device.
Figure 9:
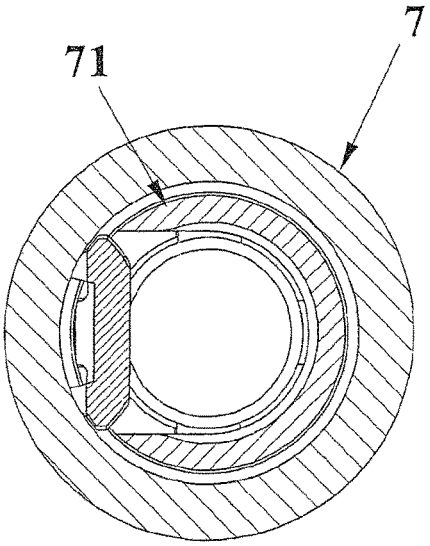
FIG. 9 is a further cross-sectioned view, taken through the plane IX-IX of FIG. 7, of the above switching or deviating device.
Figure 7:
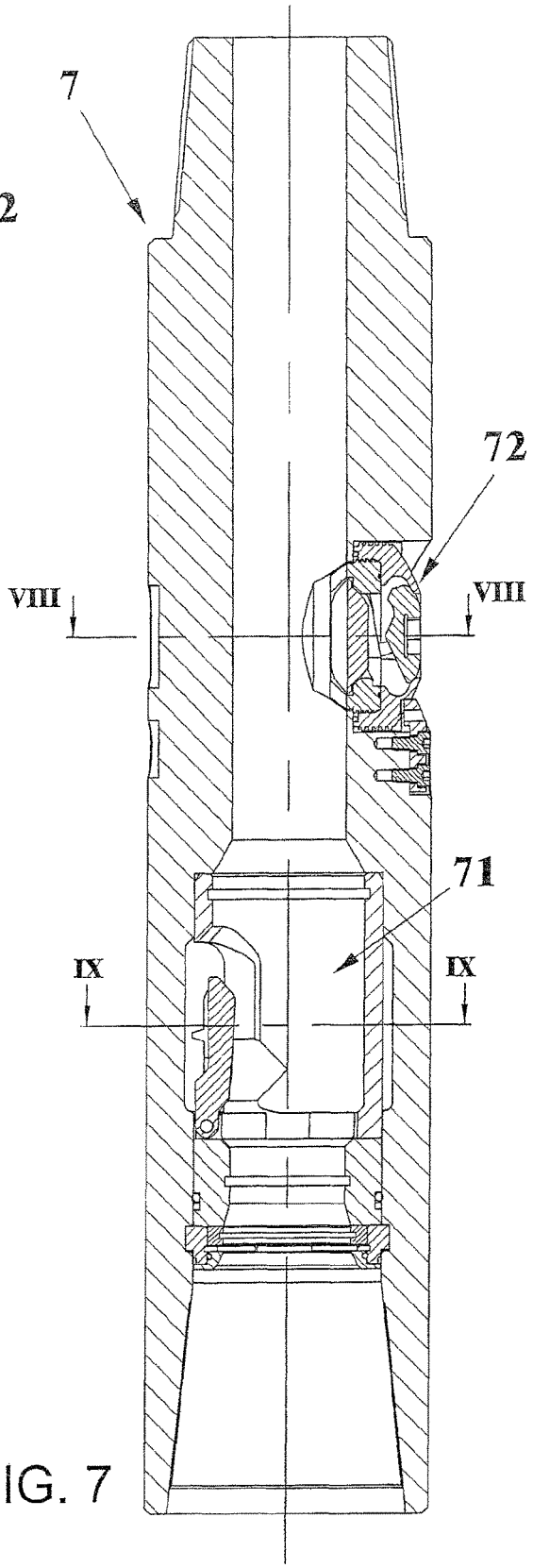
FIG. 7 is a cross-sectioned view of a switching or deviating device.
Figure 10:
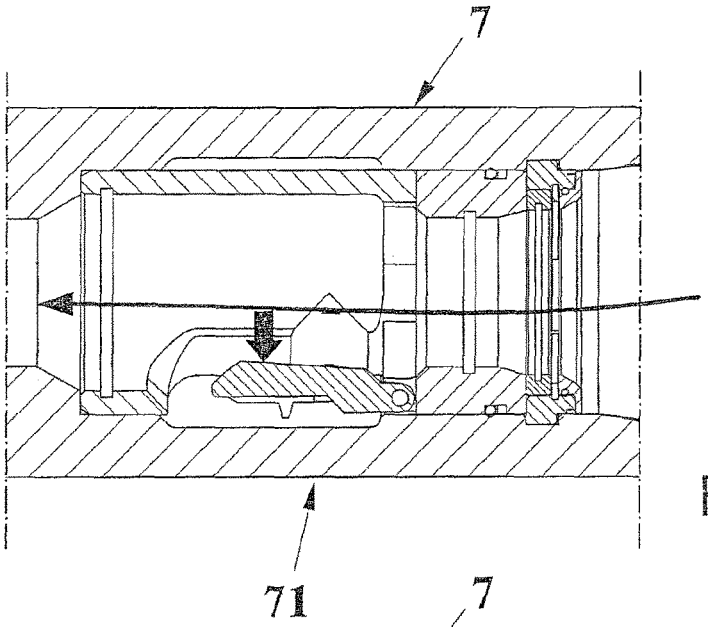
FIGS. 10-12 are further cross-sectioned views, showing an operation of a radial valve of the switching or deviating device.
Figure 11:
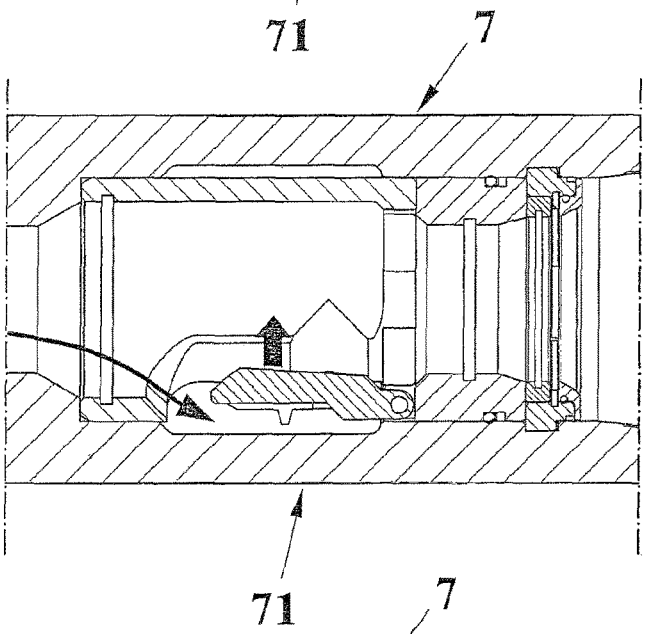
Figure 12:
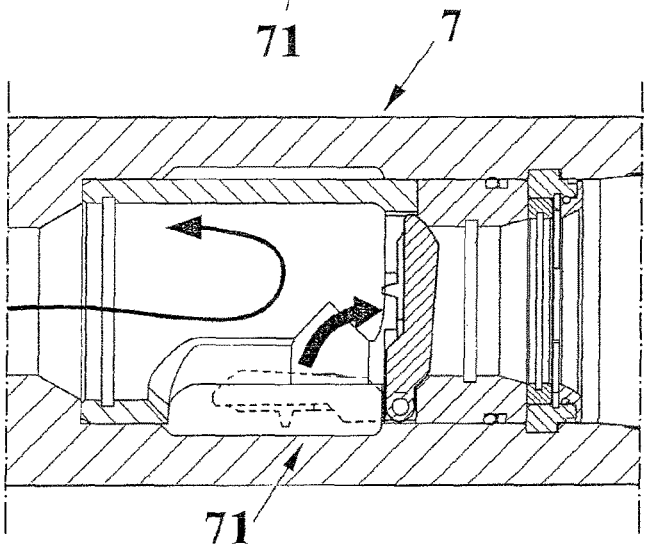
Figure 13:
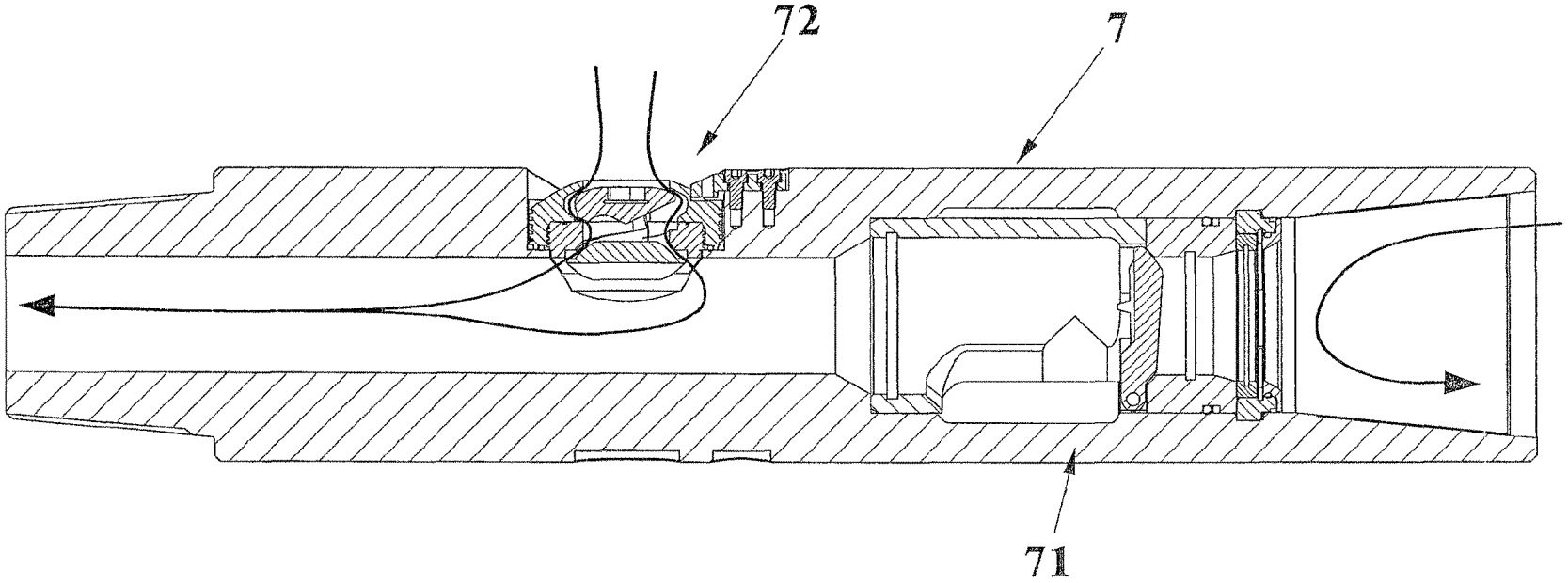
FIG. 13 is a further cross-sectioned view showing an operating diagram of the switching device.
Figure 14:
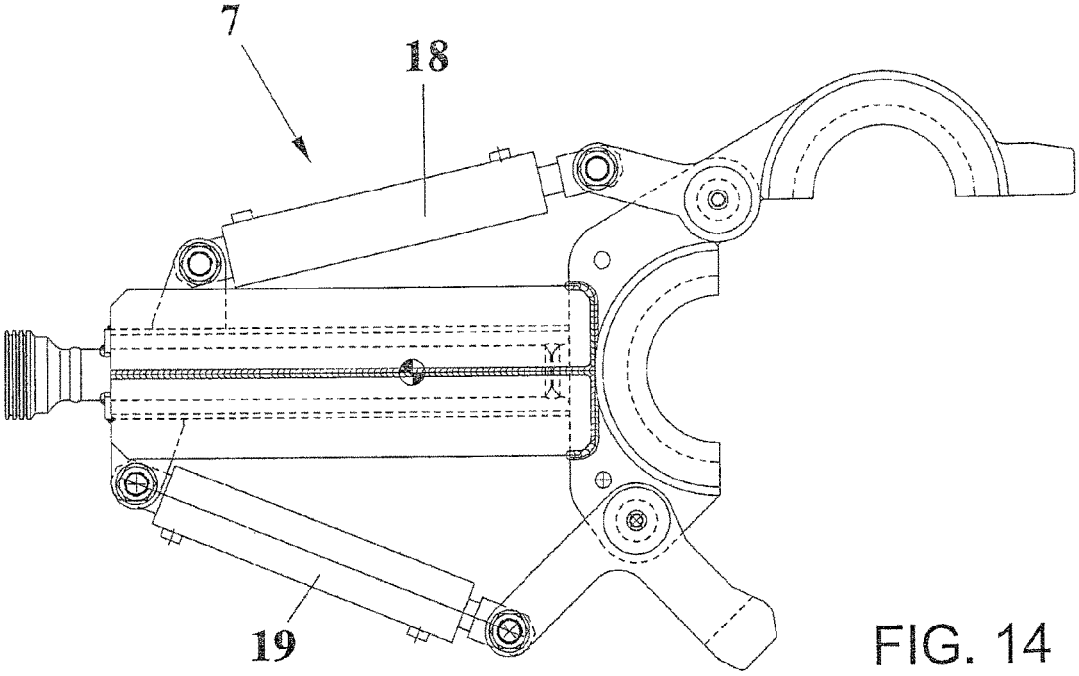
FIGS. 14 and 15 are top plan views of a gripping mechanism of the switching device.
Figure 15:
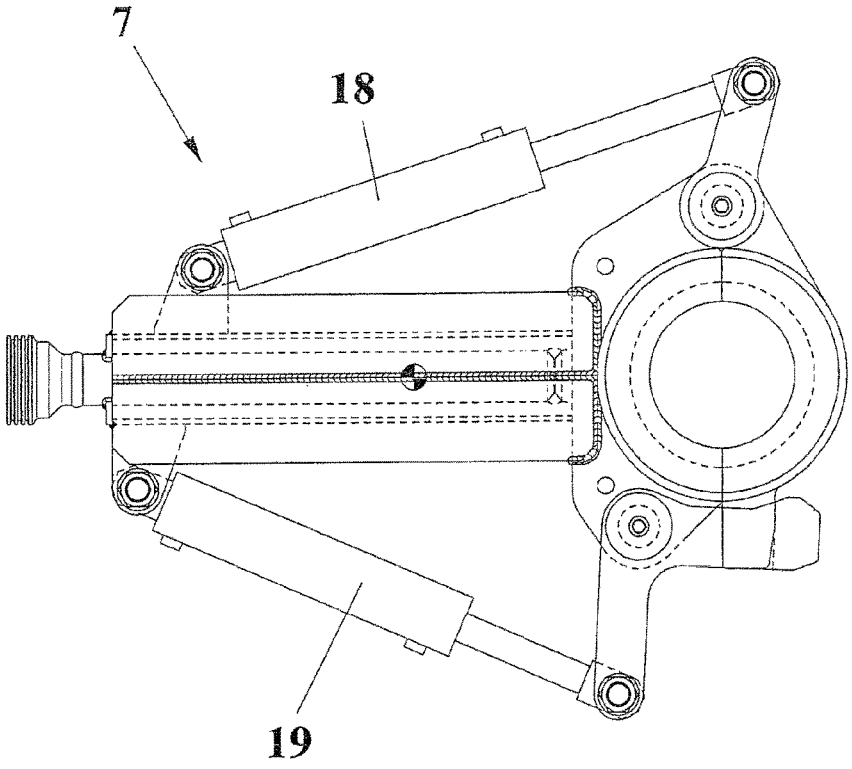
Figure 16:
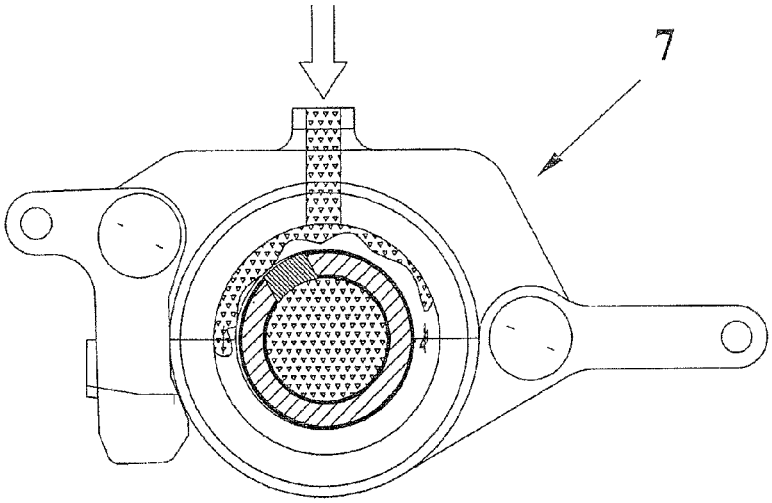
FIGS. 16-19 show operating steps for feeding a drilling mud material through said switching device.
Figure 17:
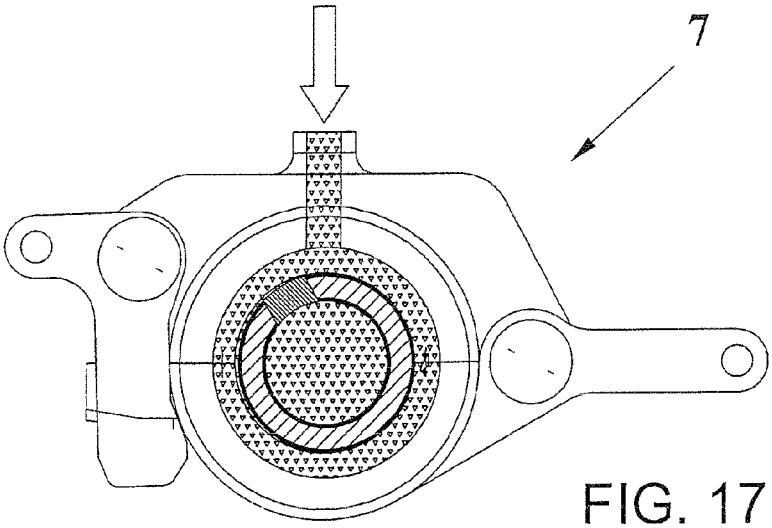
Figure 18:
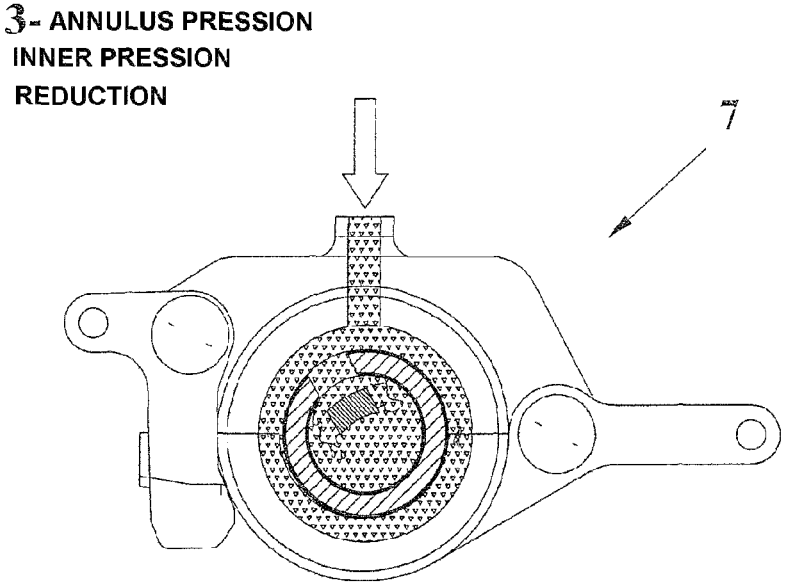
Figure 19:
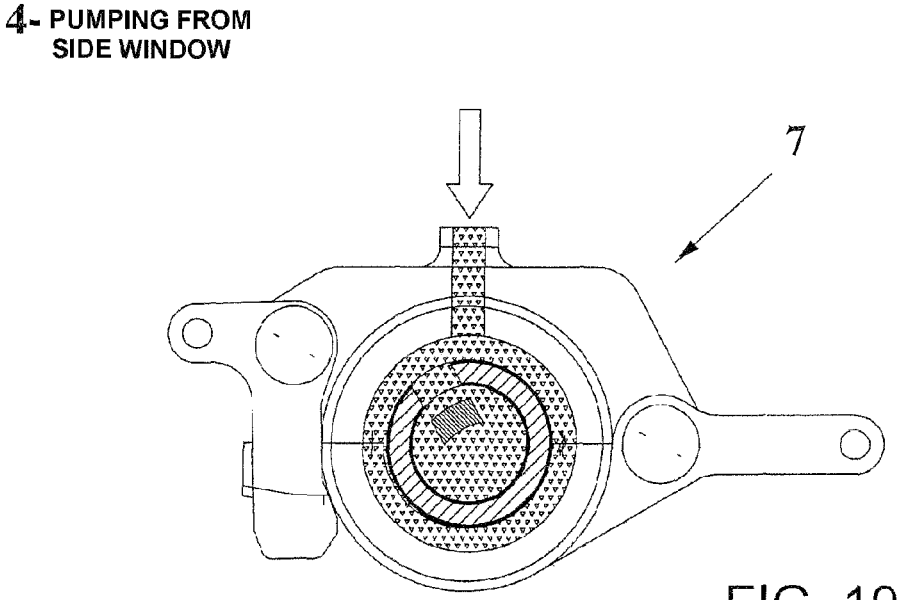

FIGS. 5 and 6 show the hydraulic actuator operating the above valves.

Thus, after having switched or deviated the flow, it is possible to discharge the pressure into the chamber with an interrupted flow, by a bleed valve, which comprises a bleeding speed adjusting restricted port.

After having interrupted and bled the flow, the components, which are either the drilling rod or switching device 7, causing the operating mud to pass through the radial valve 72, may be safely operated.

The switching cycle in both directions is carried out any times the drilling rod is exchanged, both in a drilling and in an upward or inactive return operation.

Then, by passing through the top drive, the mud enters the drilling rods and the well 4.

Said switching device 7 in the drilling battery allows to achieve a continuous drilling mud circulation.

In fact, the switching device 7, arranged in the drilling battery, has an outer size similar to that of the drilling rods allowing further special operating equipment to pass therethrough.

Moreover, said switching device 7 comprises both the withdrawable axial 71 and radial 72 valves, for conveying the fluid in the two conveying directions while allowing the rod to be replaced without causing any further mud circulation.

In such an operation, the axial valve 71 is pressed on the inner walls of the valve body by the conveyed mud, in a standard mud circulation operation, and it is displaced to a closure position thereof as the mud flow is conveyed through the radial valve 72.

Said radial valve 72, held in target position by a holding spring, provides a hydraulic sealing in an outward radial direction, and may be opened only under an outer pressure greater than the inner one (increased by the force due to the spring urging).

In an operating condition, it is possible to find pressures at the well and rod gap larger than that in said rods and, accordingly, it is preferred to provide a second backup valve for preventing mud from entering the rod, with consequent operation problems like those of a perforated rod.

This backup valve is mechanically operated by a hydraulic actuator, and the operating mud flow rate passes through the switching device 7, encompassing the valve body.

The backup valve actuator comprises a specifically designed actuating cylinder performing a standard stroke in an axial direction; after having achieved a full closure condition, then, by a key element engaged in the backup valve housing, other two chambers allowing the cylinder stem to rotate thereby the valve three foot elements are disengaged from corresponding helical planes.

Since, in this mode of operation, the fluid, either air or mud, between the radial valve and backup valve is not pressed, the actuator must accordingly overcome only the friction force in the backup valve sealing plane and, accordingly, a portion of the operating force will press on the back of the valve, in a case of a radial valve loss.

Accordingly, the backup valve operates not only for allowing outside fluids to enter, but also as an outward double barrier.

After having opened the backup valve, it is necessary to pump fluid through the mud inlet switching device 7, which may be automatically operated by a crane arm.

Said switching device 7 being clamped about said valve by two clamping cylinders 18 and 19.

Gasket elements are herein provided to form a sealed chamber to hold and direct the fluid in the radial valve.

Said chamber encompasses the overall valve and allows the operation of said radial valve 72 to be made independent from a set direction and, moreover, prevents failures and losses in case said rods would be accidentally rotated, for example during a disengaging thereof as the rods are subjected to a driving torque.

Upon ending the rod exchanging cyclical operation, the first skid 13 recovers the flow direction at the axial inlet of the valve, by automatically opening the axial valve 71, while reducing the lateral flow with a corresponding closing of the radial valve 72.

Accordingly, the actuator may close the backup valve and, upon discharging the pressure from the switching device 7, the drilling operation may be recovered.

The switching device 7 is assembled in the rod assembling operation.

More specifically, said switching device 7 is engaged in the top portion of the drilling string, which may comprise either one or more drilling rods, thereby it is necessary to provide a suitable number of said switching devices, depending on the well depth to be drilled in a continuous circulating drilling mode of operation.

Some replacement drilling strings are provided for fitting any malfunction conditions.

Thus, by resuming the mud cycle, the well 4 is finally reached.

By downward following the rod inner hole, as well as in the re-raising operation in the rod and well 4 gap, the mud is now caused to contact the ground being drilled, thereby either dispersing through the ground fractures or being enriched with waste materials which are recovered to the surface.

The control of the above phenomena will provide a precise knowledge of the well conditions, thereby preventing any blowing up or collapsing of the well walls.

The upward moving mud is conveyed to a mud processing line to be filtered and regenerated before being again fed to the circuit.

The system of the present invention provides, before this operating step, to cause the mud to pass through the second switching manifold 16, which deviates or sends the mud to the second skid 14.

At first, the mud passes through the density measuring device 5 and then through the second Venturi measuring device 2, thereby its parameters may be again measured.

This information is automatically processed by a processing program showing how to change the choke valve 3 opening, to provide a suitable counter-pressure in the well based on contingent situations.

Then, the mud is recovered to its original line through the second switching manifold 16.

A filtering and reconditioning system 20 recovers the mud to the target conditions before re-introducing it into the mud tank or basin 11 and accordingly into the circuit.

It has been found that the invention fully achieves the intended aim and objects.

In fact, the invention has provided a system for controlling continuously circulated drilling mud flow rates, characterized in that the well inlet and outlet drilling mud is shut off to detect or measure its flow rate and density by a Venturi measuring device.

The circulation of the mud is deviated without hammering phenomena, owing to the provision of the disclosed male valve, and of a compact actuator, arranged in the first skid.

By said switching device 7, the drilling rods may be exchanged without shutting off the mud circulation.

The normally open axial valve, arranged in the drilling string, does not affect the mud passage, and the specifically designed equipment included in the well bore prevents well blowing up phenomena, by fully closing the axial valve with a consequent reversal of the circulating mud direction.

The fluid is introduced into the drilling rod in a radial direction, without reducing the rod inner diameter thereby allowing a passage of target equipment and mud, and preventing any losses in the operating step for shutting off the mud in the same direction.

The provision of the second safety valve prevents any losses of the main valve while providing a hydraulic sealing in an opposite direction.

Moreover, the switching device 7 allows the pressurized fluid to be introduced, through the lateral or side valve, in a main duct, also under a pressurized condition, in an automatic manner, without any operations to be performed by surveying personnel.

The system according to the present invention shows how to operate on a choke valve, to provide a proper pressure gradient through the well during the overall drilling operation, including the rod exchanging step.

The present invention allows moreover to properly control the drilling mud thereby preventing said drilling mud from being absorbed in the well as well as any blowing-up phenomena.

Furthermore, the inventive system provides a full control of the well conditions, possible blowing up or battery engagements, continuous cleaning of the well bore at each drilling time, with the maximum increase of safety for the personal owing to the fact that all the drilling operations have been automatized.

In practicing the invention, the used materials, as well as the contingent size may be any, depending on requirements.

The invention claimed is:

1. A method for continuously controlling a fluid flow rate through a well, said method comprising:

detecting a first flow rate by a first Venturi measuring device at an inlet of the well;

detecting a second flow rate by a second Venturi measuring device at an outlet of the well;

detecting a density measurement by a series arranged density measuring device cooperating with the second Venturi measuring device and a choke valve arranged downstream of the well;

detecting a flow-rate difference based on the first flow rate and the second flow rate;

arranging a switching device in a drilling battery to allow drilling mud to be continuously circulated in the well during a drilling rod exchanging operation; and adjusting a flow rate by the choke valve based on the flow-rate difference to provide a desired pressure gradient through the well during the drilling rod exchange operation.

2. The method of claim 1, wherein the switching device has an outer size similar to the drilling rod, thereby allowing any special equipment to pass through an inside of the switching device.

3. The method of claim 1, wherein the switching device comprises an axial valve and a radial valve, allowing said fluid to pass through in two directions.

4. The method of claim 3, wherein said axial and radial valves of said switching device are withdrawable valves; said axial valve being pressed on inner walls of a valve body by a passing through mud during a conventional mud circulating step and being displaced to a closing position as the mud flow passes through the radial valve; said radial valve, being held at a target position by a holding spring, providing a hydraulic sealing in an outward radial direction and being adapted to be opened only as an outer pressure is larger than an inner pressure, increased by an urging spring force.

5. The method of claim 3, wherein the switching device comprises a backup valve preventing said drilling mud from entering said rod; said backup valve being mechanically controlled by a hydraulic actuator and said drilling mud flow-rate being provided by said switching device encompassing a body of the valve.

6. The method of claim 5, wherein the backup valve has an actuator comprising an actuating cylinder providing a standard cylinder stroke in an axial direction and, at a full closing condition, allowing valve three foot elements to disengage from helical planes.

7. The method of claim 1, further comprising a first skid including the first Venturi measuring device, and a hydraulic circuit for switching the mud flow-rate in both a radial and an axial direction of said switching device, said hydraulic circuit including male valves.

8. The method of claim 7, further comprising a first switching manifold, associated with said first skid, and a second switching manifold, associated with a second skid, said first and second switching manifolds being arranged upstream and downstream of said respective skids; each said switching manifolds comprising three valves thereby allowing an original hydraulic circuit to be recovered while insulating control circuits.

9. The method of claim 7, wherein the hydraulic circuit of said first skid is adapted to control a flow direction without hammering phenomena.

10. An apparatus for continuously controlling a fluid flow rate through a well, comprising:

a first Venturi measuring device at an inlet of the well;

a second Venturi measuring device at an outlet of the well, the second Venturi device detecting a flow-rate difference with respect to the first Venturi measuring device, wherein a flow-rate is adjusted by a choke valve arranged downstream of said well based on the flow-rate difference;

a series arranged density measuring device, cooperating with the second Venturi measuring device and said choke valve; and a switching device to be arranged in a drilling battery thereby allowing drilling mud to be continuously circulated during a drilling rod exchanging operation.

11. The apparatus of claim 10, wherein the switching device has an outer size similar to the drilling rod, thereby allowing any special equipment to pass through an inside of the switching device.

12. The apparatus of claim 10, wherein the switching device comprises an axial valve and a radial valve, allowing said drilling mud to pass through in two directions.

13. The apparatus of claim 12, wherein said axial and radial valves of said switching device are withdrawable valves; said axial valve being pressed on inner walls of a valve body by a passing through mud during a conventional mud circulating step and being displaced to a closing position as the mud flow passes through the radial valve; said radial valve, being held at a target position by a holding spring, providing a hydraulic sealing in an outward radial direction and being adapted to be opened only as an outer pressure is larger than an inner pressure, increased by an urging spring force.

14. The apparatus of claim 12, wherein the switching device comprises a backup valve preventing said drilling mud from entering said rod; said backup valve being mechanically controlled by a hydraulic actuator and said drilling mud flow-rate being provided by said switching device encompassing a body of the valve.

15. The apparatus of claim 14, wherein the backup valve has an actuator comprising an actuating cylinder providing a standard cylinder stroke in an axial direction and, at a full closing condition, allowing valve three foot elements to disengage from helical planes.

16. The apparatus of claim 10, further comprising a first skid including the first Venturi measuring device, and a hydraulic circuit for switching the mud flow-rate in both a radial and an axial direction of said switching device, said hydraulic circuit including male valves.

17. The apparatus of claim 16, further comprising a second skid including the second Venturi measuring device, the density measuring device, the choke valve and an electronic central processing unit, said electronic central processing unit processing data with reference parameters and adjusting a choke valve inlet port.

18. The apparatus of claim 16, further comprising a first switching manifold, associated with said first skid, and a second switching manifold, associated with a second skid, said first and second switching manifolds being arranged upstream and downstream of said respective skids; each said switching manifolds comprising three valves thereby allowing an original hydraulic circuit to be recovered while insulating control circuits.

19. The apparatus of claim 16, wherein the hydraulic circuit of said first skid is adapted to control a flow direction without hammering phenomena.

* * * * *